US009028222B2

(12) United States Patent
Perkinson

(10) Patent No.: US 9,028,222 B2
(45) Date of Patent: May 12, 2015

(54) VARIABLE OUTPUT PUMP

(75) Inventor: Robert H. Perkinson, Stonington, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 735 days.

(21) Appl. No.: 13/218,753

(22) Filed: Aug. 26, 2011

(65) Prior Publication Data

US 2013/0052047 A1 Feb. 28, 2013

(51) Int. Cl.

| | |
|---|---|
| ***F04B 5/00*** | (2006.01) |
| ***F04C 11/00*** | (2006.01) |
| ***F04C 15/00*** | (2006.01) |
| *F04C 2/18* | (2006.01) |

(52) U.S. Cl.

CPC ..... *F04C 11/001* (2013.01); *F04C 2/18* (2013.01); *F04C 15/0057* (2013.01)

(58) Field of Classification Search

CPC ..... F04C 11/00; F04C 15/0057; F16H 61/44; F16H 15/0061

USPC ..... 417/224, 245, 247, 410.4, 423.6

See application file for complete search history.

(56) References Cited

U.S. PATENT DOCUMENTS

| | | | | |
|---|---|---|---|---|
| 2,526,830 | A | 10/1950 | Purcell | |
| 4,607,486 | A | 8/1986 | Cole | |
| 5,226,362 | A | 7/1993 | Iaccino et al. | |
| 6,174,254 | B1 | 1/2001 | Tsai | |
| 6,244,829 | B1 | 6/2001 | Yumoto | |
| 7,632,205 | B2 * | 12/2009 | Varunny | 475/225 |
| 2002/0076344 | A1 | 6/2002 | Clarke | |
| 2003/0017903 | A1 * | 1/2003 | Duan | 475/230 |
| 2009/0041593 | A1 | 2/2009 | Yokoi et al. | |
| 2009/0088280 | A1 | 4/2009 | Warren | |
| 2009/0148333 | A1 | 6/2009 | Elder | |
| 2010/0202913 | A1 | 8/2010 | Shimamura | |

* cited by examiner

*Primary Examiner* — Peter J Bertheaud
*Assistant Examiner* — Dominick L Plakkoottam
(74) *Attorney, Agent, or Firm* — Cantor Colburn LLP

(57) ABSTRACT

A variable output pump includes a fluid input, a control stage pump having an input portion and an output portion, a main stage pump having an input portion and an output portion, and a differential linkage in mechanical communication with the control stage pump and the main stage pump. The input portion of the control stage pump is in fluid communication with the fluid input and the input portion of the main stage pump is in fluid communication with the fluid input and the output portion of the control stage pump.

16 Claims, 2 Drawing Sheets

VARIABLE OUTPUT PUMP

BACKGROUND OF THE INVENTION

The present disclosure is directed to pumps, and more particularly, to variable output pump systems.

Positive displacement pumps, for example gear pumps, generally have a constant volumetric output per revolution of mechanical input. Furthermore, fluid output is substantially independent of output pressure required to provide flow to a load.

BRIEF DESCRIPTION OF THE INVENTION

According to an example embodiment of the present invention, a variable output pump includes a fluid input, a control stage pump having an input portion and an output portion, a main stage pump having an input portion and an output portion, and a differential linkage in mechanical communication with the control stage pump and the main stage pump. The input portion of the control stage pump is in fluid communication with the fluid input and the input portion of the main stage pump is in fluid communication with the fluid input and the output portion of the control stage pump.

According to another example embodiment of the present invention, a variable output pump includes a mechanical input member, a differential linkage in mechanical communication with the mechanical input member, a fluid input, a control stage pumping portion in fluid communication with the fluid input and in mechanical communication with the differential linkage, and a main stage pumping portion in fluid communication with the fluid input and the control stage pumping portion, and in mechanical communication with the differential linkage.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

According to example embodiments of a present invention, mechanically-driven variable output pumps are presented which provide a fluid output which is variable over a constant output pressure and constant rotational speed of mechanical input. The technical benefits of example embodiments include reduced energy consumption and reduced complexity as compared to pump systems with bleed-off valves and/or recirculation of waste fluid flow.

Figure 1:
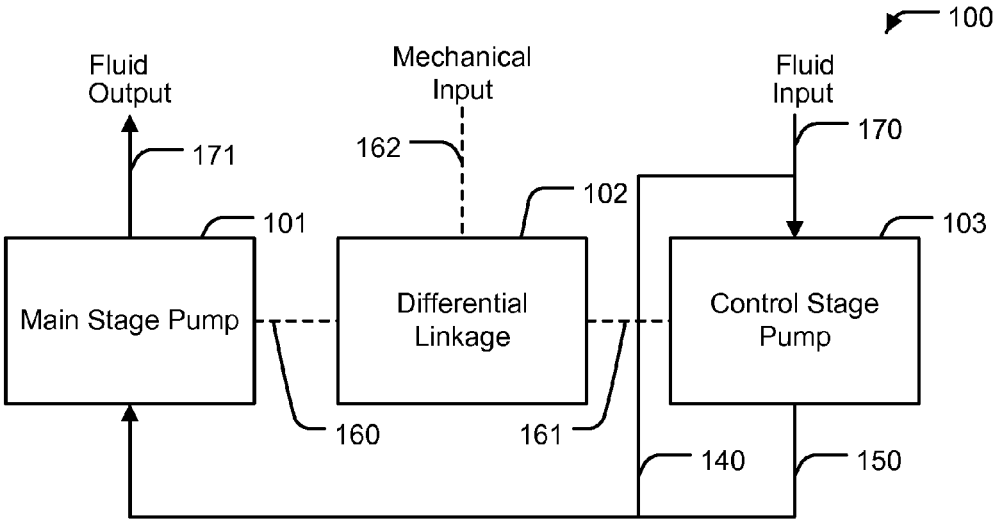
FIG. 1 is a schematic of a variable output pump, according to an example embodiment.

Turning to FIG. 1, a variable output pump 100 includes a fluid input 170, fluid output 171, and mechanical input member 162. The fluid input 170 provides a working fluid to the pump 100, which, upon receiving mechanical input, pumps the working fluid to the fluid output 171. The mechanical input member 162 may be any appropriate mechanical input according to a desired application. For example, the mechanical input 162 may be an input shaft or rotation member configured to provide a rotational force to the pump 100.

As illustrated in FIG. 1, the pump 100 includes at least two pump stages or pumping portions 101 and 103 in mechanical communication through a differential linkage 102. A main stage pump 101 may be arranged to provide fluid output for the pump 100, while a control stage pump 103 and the main state pump 101 may be arranged to receive fluid input 170 of the pump 100. The main stage pump 101 and the control stage pump 103 may be of substantially the same dimensions and/or capacity, or may be different according to any desired implementation. For example, each pump 101, 103 may include an input portion and an output portion, and may have a rated capacity according to volumetric flow per revolution. The rated capacity of the control stage pump 103 may be greater than, lower than, or match the rated capacity of the main stage pump 101.

According to at least one example embodiment of the present invention, both the main stage pump 101 and the control stage pump 103 are positive displacement pumps, for example, gear pumps.

As illustrated in FIG. 1, the main stage pump 101 is in fluid communication with the fluid input 170 of the pump 100 through fluid bypass 140. Furthermore, the control stage pump 103 is in fluid communication with the main stage pump 101 through fluid channel 150 and receives fluid from fluid input 170.

As further illustrated in FIG. 1, the differential linkage 102 is in mechanical communication with both the main stage pump 101 and the control stage pump 103. The differential linkage 102 may be any suitable differential such that rotational force input at the mechanical input 162 of the pump 100 is translated into rotational force at each of the main stage pump 101 and the control stage pump 103 through rotational members 160 and 161, respectively. The differential linkage 102 may be configured to transfer rotational force between each of the main stage pump 101 and the control stage pump 103 based upon feedback from each stage.

For example, according to one example embodiment, the differential linkage 102 is a mechanical differential configured to balance torque and rotational speed of the rotational members 160 and 161. The mechanical differential may be embodied as a set of rotating gears arranged as a general differential, planetary gear differential with coaxial shafts, or any other suitable differential.

According to at least one example embodiment, a mechanical differential may be embodied as a set of rotating gears arranged such that Equation 1, provided below, is satisfied:

$$N_{Control}+N_{Main}C*N_{Input} \qquad \text{Equation 1}$$

According to Equation 1, $N_{control}$ is the rotational speed of the rotational member 161, $N_{Main}$ is the rotational speed of the rotational member 160, $N_{Input}$ is the rotational speed of the mechanical input 162, and C is a constant denoting the proportional relationship of the mechanical gears within the differential linkage 102. Furthermore, according to this example embodiment, the set of rotating gears are also arranged such that Equation 2, provided below, is satisfied:

$$\text{Torque}_{Main}=\text{Torque}_{control} \qquad \text{Equation 2}$$

According to Equation 2, $\text{Torque}_{Main}$ is the torque as seen at rotational member 160 and $\text{Torque}_{Control}$ is the torque as seen at rotational member 161 by the differential linkage 102.

According to some example embodiments, the differential linkage may be controlled through an external device (not shown for clarity) that varies the rotational speed of each of the main stage pump 101 and control stage pump 103 through application of frictional control forces at the differential linkage 102. Alternatively, frictional forces may be applied at the rotational member 161 for control of a rotational speed of both pump stages. Thus, total fluid output of the pump 100 may be varied for a constant input rotational speed at the mechanical input 162. For example, as the rotational speed of rotational member 161 is reduced, the differential linkage 102 translates and balances this with increased speed at rotational member 160, thereby increasing fluid flow at fluid output 171. Conversely, an increase in speed at the rotational member 161 decreases the speed of the rotational member 160, thereby reducing fluid flow at fluid output 171.

Figure 2:
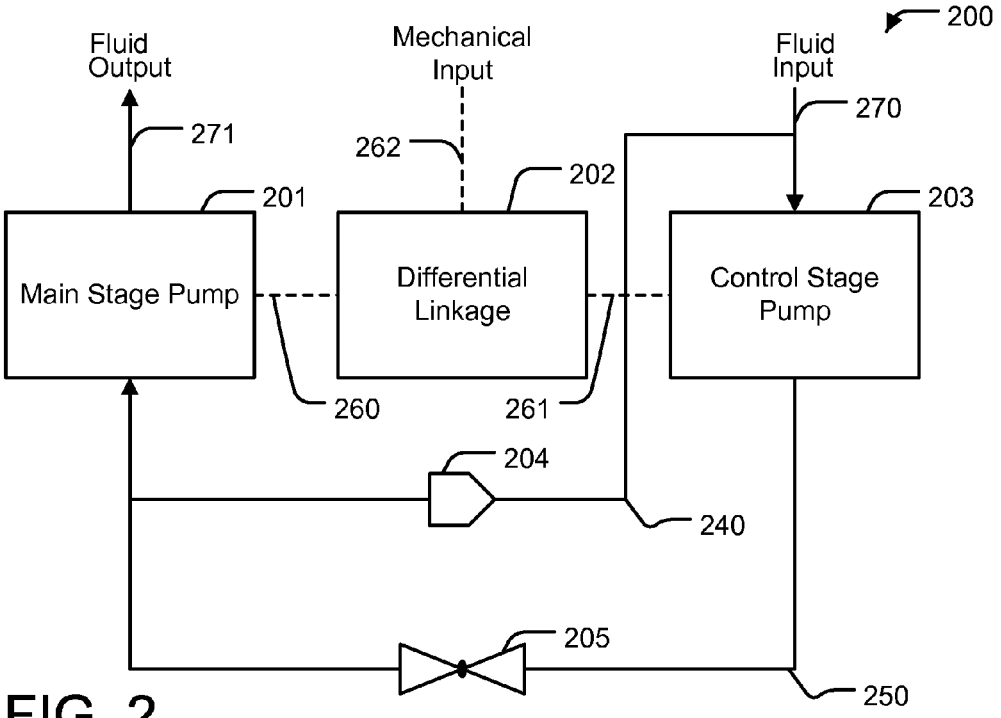
FIG. 2 is a schematic of a variable output pump, according to another example embodiment.

According to another embodiment, fluid output may be varied through application of control valves to limit fluid flow from a control stage pump, for example, as illustrated in FIG. 2.

Turning to FIG. 2, a variable output pump 200 includes a fluid input 270, fluid output 271, and mechanical input member 262. The fluid input 270 provides a working fluid to the pump 200, which, upon receiving mechanical input, pumps the working fluid to the fluid output 271. The mechanical input member 262 may be any appropriate mechanical input according to a desired application. For example, the mechanical input member 262 may be an input shaft or rotational member configured to provide a rotational force to the pump 200.

As illustrated in FIG. 2, the pump 200 includes at least two pump stages or pumping portions 201 and 203 in mechanical communication through a differential linkage 202. In particular, a main stage pump 201 may be arranged to provide fluid output for the pump 200 and a control stage pump 203 may be arranged to receive fluid input of the pump 200. The main stage pump 201 and the control stage pump 203 may be of substantially the same dimensions and/or capacity, or may be different according to any desired implementation.

According to at least one example embodiment of the present invention, both the main stage pump 201 and the control stage pump 203 are positive displacement pumps, for example, gear pumps.

As illustrated in FIG. 2, the main stage pump 201 is also in fluid communication with the fluid input 270 of the pump 200 through fluid bypass 240 and check valve 204. The check valve 204 may reduce or eliminate fluid backflow on the fluid bypass 240. The control stage pump 203 is in fluid communication with both the fluid input 270 of the pump 200 and the main stage pump 201. In particular, the control stage pump 203 is in fluid communication with the main stage pump 201 through fluid channel 250 and control valve 205. The control valve 205 may be any suitable control valve configured to limit or control a flow of a working fluid therethrough. According to at least one example embodiment, the control valve 205 is a continuously adjustable control valve operative to control fluid flow from a rate of 0%-100% total available capacity. According to other example embodiments, the control valve 205 may be a discrete control valve operative to control fluid flow at two or more discrete flow rate positions.

As further illustrated in FIG. 2, the differential linkage 202 is in mechanical communication with both the main stage pump 201 and the control stage pump 203. The differential linkage 202 may be any suitable differential such that rotational force input at the mechanical input member 262 of the pump 200 is translated into rotational force at each of the main stage pump 201 and the control stage pump 203 through rotational members 260 and 261, respectively. The differential linkage 202 may be configured to transfer rotational force between each of the main stage pump 201 and the control stage pump 203 based upon feedback from each stage.

For example, according to one example embodiment, the differential linkage 202 is a mechanical differential configured to balance torque and rotational speed of the rotational members 260 and 261. The mechanical differential may be embodied as a set of rotating gears arranged as a general differential, planetary gear differential with coaxial shafts, or any other suitable differential.

According to at least one example embodiment, a mechanical differential 202 may be embodied as a set of rotating gears arranged such that Equation 3, provided below, is satisfied:

$$N_{Control}+N_{Main}C*N_{Input} \qquad \text{Equation 3}$$

According to Equation 3, $N_{Control}$ is the rotational speed of the rotational member 261, $N_{Main}$ is the rotational speed of the rotational member 260, $N_{Input}$ is the rotational speed of the mechanical input 262, and C is a constant denoting the functional relationship of the mechanical gears within the differential linkage 202. Furthermore, according to this at least one example embodiment, the set of rotating gears are also arranged such that Equation 4, provided below, is satisfied:

$$\text{Torque}_{Main}=\text{Torque}_{Control} \qquad \text{Equation 4}$$

According to Equation 4, $\text{Torque}_{Main}$ is the torque as seen at rotational member 260 and $\text{Torque}_{Control}$ is the torque as seen at rotational member 261 by the differential linkage 202.

According to some example embodiments, the control valve 205 may be controlled through an external device (not shown for clarity) that varies the rotational speed of the control stage pump 203 through restriction of fluid flow at the control valve 205. Thus, total fluid output of the pump 200 may be varied for a constant input rotational speed at the mechanical input 262. For example, as fluid flow is restricted at the control valve 205, the rotational speed of a positive displacement embodiment of control stage pump 203 is reduced. This reduced speed is mechanically translated through the differential linkage 202 into increased rotational speed of the main stage pump 201, thereby increasing fluid flow at fluid output 271. The converse also holds true, for example, increased speed at the control stage pump 203 through non-restricted flow at the control valve 205 results in reduced speed at the main stage pump 201, thereby decreasing total fluid flow at the fluid output 271.

Additional variations including specific pump types, differential types, and pump sizing are also possible depending upon any desired implementation. For example, FIG. 3 illustrates a schematic of a variable output gear pump, according to an example embodiment.

Figure 3:
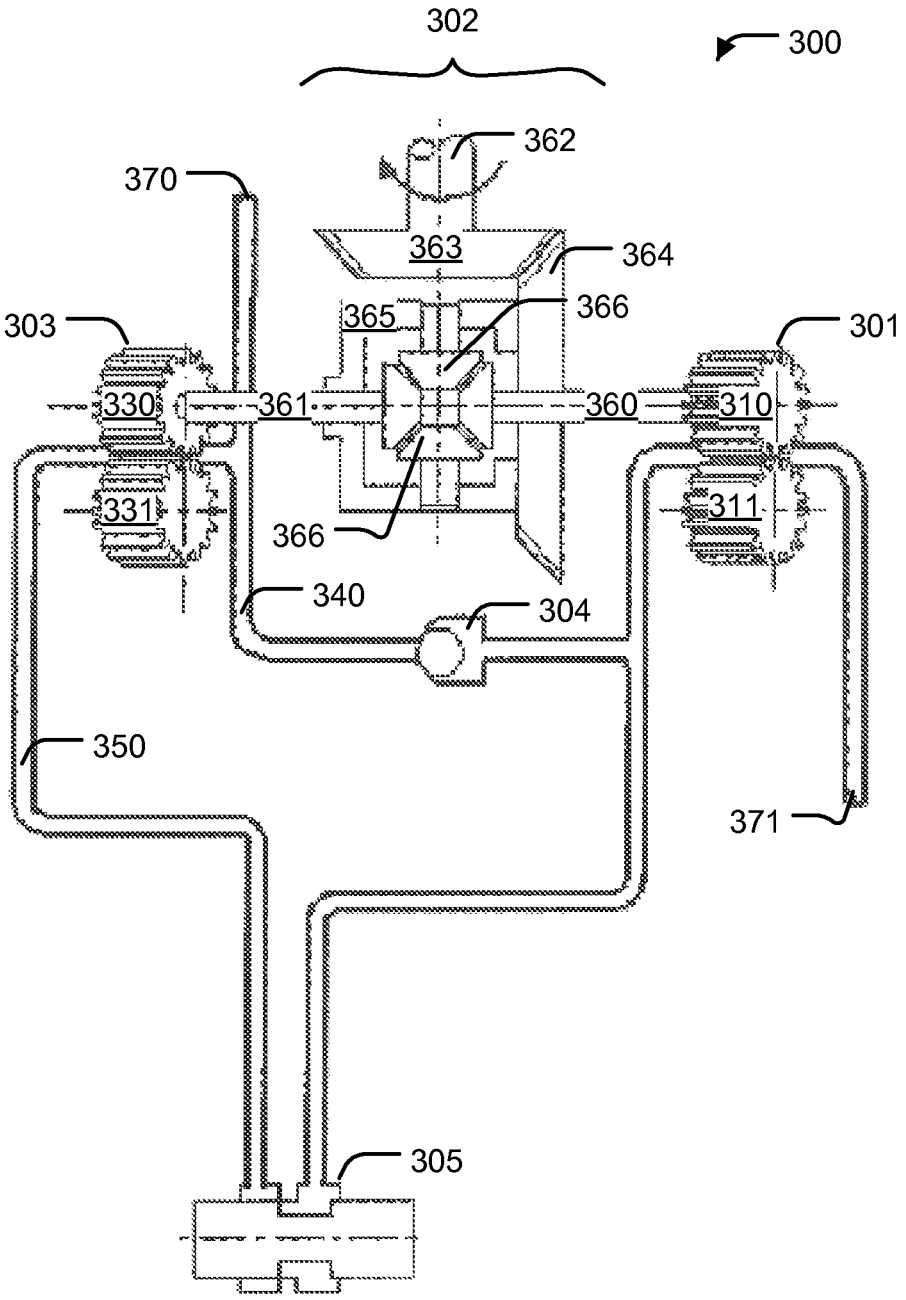
FIG. 3 is a detailed schematic of a variable output gear pump, according to an example embodiment.

Turning to FIG. 3, a variable output pump 300 includes a fluid input 370, fluid output 371, and mechanical input 362. The fluid input 370 provides a working fluid to the pump 300, which, upon receiving mechanical input, pumps the working fluid to the fluid output 371. The mechanical input 362 may be any appropriate mechanical input according to a desired application. For example, the mechanical input 362 may be an input shaft or rotational member configured to provide a rotational force to the pump 300.

As illustrated in FIG. 3, the pump 300 includes at least two pump stages 301 and 303 in mechanical communication through a differential linkage 302. A main stage pump 301 may be arranged to provide fluid output for the pump 300, while a control stage pump 303 may be arranged to receive fluid input of the pump 300. As illustrated, the main stage pump 303 can also receive fluid from fluid input 371 via fluid bypass 340. The main stage pump 301 and the control stage pump 303 may be of substantially the same dimensions and/or capacity, or may be different according to any desired implementation.

According to FIG. 3, both the main stage pump 301 and the control stage pump 303 are positive displacement gear pumps. In the illustrated embodiment, the main stage pump 301 includes two pump gears 310 and 311 and the control stage pump 303 includes two pump gears 330 and 331. Of course, the number of pump gears in either or both main stage pump 301 and control stage pump 303 could be varied from what is illustrated in FIG. 3.

As illustrated in FIG. 3, the main stage pump 301 is in fluid communication with the input 370 of the pump 300 through fluid bypass 340 and check valve 304. The check valve 304 may reduce or eliminate fluid backflow on the fluid bypass 340. Furthermore, the control stage pump 303 is in fluid communication with both the fluid input 370 of the pump 300 and the main stage pump 301 through fluid channel 350 and control valve 305. The control valve 305 is configured to limit or control a flow of a working fluid therethrough. According to FIG. 3, the control valve 305 is a continuously adjustable control valve operative to control fluid flow from a rate of 0%-100% total available capacity.

As further illustrated in FIG. 3, the differential linkage 302 is in mechanical communication with both the main stage pump 301 and the control stage pump 303. The differential linkage 302 translates rotational force input at the mechanical input 362 of the pump 300 into rotational force at each of the main stage pump 301 and the control stage pump 303 through rotational members 360 and 361, respectively. The differential linkage 302 is configured to transfer rotational force between each of the main stage pump 301 and the control stage pump 303 based upon feedback from each stage.

In one embodiment, the differential linkage 302 is a mechanical differential configured to balance torque and rotational speed of the rotational members 360 and 361. The mechanical differential includes a set of rotating gears 363, 364, and 366 and rotating housing 365 arranged as a general differential satisfying Equations 1-4 provided above.

According to FIG. 3, the control valve 305 is controlled through an external device (not shown for clarity) which varies the rotational speed of the control stage pump 303 through restriction of fluid flow at the control valve 305. Thus, total fluid output of the pump 300 may be varied for a constant input rotational speed at the mechanical input 362. For example, as fluid flow is restricted at the control valve 305, the rotational speed of control stage pump 303 is reduced. This reduced speed is mechanically translated through the differential linkage 302 into increased rotational speed of the main stage pump 301, thereby increasing fluid flow at fluid output 371. Furthermore, increased speed at the control stage pump 303 through non-restricted flow at the control valve 305 results in reduced speed at the main stage pump 301, thereby decreasing total fluid flow at the fluid output 371.

As described above, example embodiments include variable output pump systems including differential linkages arranged to balance torque and rotational speed of at least two pump stages. Through control of fluid flow at a control stage pump either through application of frictional forces or restriction of fluid flow therethrough, a total fluid flow of the pump systems may be varied while maintaining a constant input rotational speed. Thus, precise control of fluid output is possible without waste heat generally associated with pump systems.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A variable output pump, comprising:

a fluid input;

a control stage pump with a first input portion and a first output portion, wherein the first input portion of the control stage pump is in fluid communication with the fluid input;

a main stage pump with a second input portion and a second output portion, wherein the second input portion of the main stage pump is in fluid communication with the fluid input and the first output portion of the control stage pump;

a differential linkage in mechanical communication with the control stage pump and the main stage pump; and a control valve arranged in serial fluid communication between the first output portion and the second input portion;

wherein the control valve is configured for restricted fluid flow or non-restricted fluid flow; and wherein a volume of fluid flow through the control valve determines rotational speed of each of the control stage pump and the main stage pump via the differential linkage.

2. The variable output pump of claim 1, wherein the control valve is configured to modify a pumping output of the control stage pump and the main stage pump.

3. The variable output pump of claim 1, wherein the differential linkage comprises:

a mechanical input member that is configured for constant rotational speed;

a main stage rotational member in mechanical communication with the mechanical input member; and a control stage rotational member in mechanical communication with the mechanical input member and the main stage rotational member.

4. The variable output pump of claim 3, wherein the main stage rotational member is in mechanical communication with the main stage pump and the control stage rotational member is in mechanical communication with the control stage pump.

5. The variable output pump of claim 4, wherein the differential linkage is configured to translate a change in rotational speed of the control stage rotational member to a proportional change in rotational speed of the main stage rotational member.

6. The variable output pump of claim 4, wherein the differential linkage is configured to balance torque between the control stage rotational member and the main stage rotational member.

7. The variable output pump of claim 1, further comprising:

a fluid check valve in serial fluid communication between the input portion of the main stage pump and the fluid input.

8. The variable output pump of claim 1, wherein the differential linkage is a mechanical differential.

9. The variable output pump of claim 1, wherein the main stage pump and the control stage pump are positive displacement pumps.

10. A variable output pump, comprising:

a mechanical input member;

a differential linkage in mechanical communication with the mechanical input member;

a fluid input;

a control stage pumping portion in fluid communication with the fluid input and in mechanical communication with the differential linkage;

a main stage pumping portion in fluid communication with the fluid input and the control stage pumping portion, and in mechanical communication with the differential linkage; and a control valve arranged in serial fluid communication between the control stage pumping portion and the main stage pumping portion;

wherein control of fluid flow through the control valve controls rotational speed of each of the control stage pumping portion and the main stage pumping portion through the differential linkage.

11. The variable output pump of claim 10, wherein:

the control stage pumping portion comprises at least one gear configured to displace fluid received from the fluid input; and the main stage pumping portion comprises at least one gear configured to displace fluid received from both the fluid input and the control stage pumping portion.

12. The variable output pump of claim 11, wherein the differential linkage comprises:

a main stage rotational member in mechanical communication with the at least one gear of the main stage pumping portion; and a control stage rotational member in mechanical communication with the at least one gear of the control stage pumping portion.

13. The variable output pump of claim 12, wherein the differential linkage is configured to increase a speed of the at least one gear of the main stage pumping portion in response to a decrease in speed of the at least one gear of the control stage pumping portion.

14. The variable output pump of claim 12, wherein the differential linkage is configured to decrease a speed of the at least one gear of the main stage pumping portion in response to an increase in speed of the at least one gear of the control stage pumping portion.

15. The variable output pump of claim 10, further comprising:

a fluid check valve in serial fluid communication between input portion of the main stage pumping portion and the fluid input.

16. The variable output pump of claim 3, wherein the restricted fluid flow causes a decrease in rotational speed of the control stage rotational member and an increase in rotational speed of the main stage rotational member; and wherein the non-restricted fluid flow causes a decrease in rotational speed of main stage rotational member and an increase in the rotational speed of the control stage rotational member.

* * * * *